US009062440B2

(12) United States Patent
Denzler et al.

(10) Patent No.: US 9,062,440 B2
(45) Date of Patent: Jun. 23, 2015

(54) SANITARY FUNCTIONAL UNIT

(75) Inventors: Oliver Denzler, Bottmingen (CH); Christoph Weis, Muellheim (DE); Christoph Taran, Muellheim (DE)

(73) Assignee: Neoperl GmbH, Muellheim (DE)

( * ) Notice: Subject to any disclaimer, the term of this patent is extended or adjusted under 35 U.S.C. 154(b) by 757 days.

(21) Appl. No.: 12/921,028

(22) PCT Filed: Feb. 13, 2009

(86) PCT No.: PCT/EP2009/001002
§ 371 (c)(1),
(2), (4) Date: Sep. 3, 2010

(87) PCT Pub. No.: WO2009/109284
PCT Pub. Date: Sep. 11, 2009

(65) Prior Publication Data

US 2011/0036930 A1 Feb. 17, 2011

(30) Foreign Application Priority Data

Mar. 4, 2008 (DE) ..... 10 2008 012 388

(51) Int. Cl.
*B05B 1/00* (2006.01)
*E03C 1/04* (2006.01)
(Continued)

(52) U.S. Cl.
CPC ..... *E03C 1/0404* (2013.01); *E03C 1/084* (2013.01); *E03C 1/086* (2013.01)

(58) Field of Classification Search
CPC ..... B05B 1/18; B05B 1/185; B05B 15/065; E03C 1/086; E03C 1/084; E03C 1/0404
USPC ..... 239/428.5, 390, 396, 397, 600
See application file for complete search history.

(56) References Cited

U.S. PATENT DOCUMENTS 2,790,632 A 4/1957 Mellette et al.
3,512,711 A * 5/1970 Abbott ..... 239/25
(Continued)

FOREIGN PATENT DOCUMENTS

DE 10 2005 010 549 A1 11/2006
EP 1 359 260 A2 11/2003
(Continued)

OTHER PUBLICATIONS

International Search Report including English translation dated Jun. 3, 2009 (Six (6) pages).
Form PCT/409 including partial English translation of pertinent portion (Twenty (20) pages).
(Continued)

*Primary Examiner* — Jason Boeckmann
(74) *Attorney, Agent, or Firm* — Crowell & Moring LLP

(57) ABSTRACT

A sanitary functional unit having a sleeve-shaped insert cartridge insertable into the pipe-shaped fixture outlet of a sanitary outlet fixture is provided. The insert cartridge has a water inlet at the cartridge circumference and a jet former having flow guiding walls oriented transversely to the cartridge longitudinal axis provided in the water outlet. The functional unit deflects the water jet flowing in from the axial direction such that water subsequently flows out of the fixture outlet in a nearly radial direction. The functional unit has a jet former, provided in the region of the water outlet, supporting flow guiding walls that are oriented transversely and perpendicularly to the cartridge longitudinal axis. Since the functional unit is oriented approximately coaxially to the fixture outlet, it also does not project beyond the pipe circumference of the fixture outlet.

20 Claims, 10 Drawing Sheets

(51) Int. Cl.
*E03C 1/084* (2006.01)
*E03C 1/086* (2006.01)

(56) References Cited

U.S. PATENT DOCUMENTS

| | | | | |
|---|---|---|---|---|
| 4,130,128 | A * | 12/1978 | Kaneko | 137/269 |
| 5,396,929 | A | 3/1995 | Rodriguez et al. | |
| 7,090,144 | B2 * | 8/2006 | Gross et al. | 239/26 |
| 2009/0308952 | A1 | 12/2009 | Buettgen | |

FOREIGN PATENT DOCUMENTS

| | | | |
|---|---|---|---|
| EP | 1 630 305 | A1 | 3/2006 |
| FR | 1 600 307 | A | 7/1970 |
| WO | WO 2006/094593 | A1 | 9/2006 |
| WO | WO 2008/026871 | A1 | 3/2008 |

OTHER PUBLICATIONS

PCT/ISA/237 Form including partial English translation of pertinent portion (Twelve (12) pages).

* cited by examiner

6'
18
13
7
14
1
20
6
8
14
13
4
7
9
2
31
21
31
20
8
9
12

SANITARY FUNCTIONAL UNIT

CROSS REFERENCE TO RELATED APPLICATIONS

This application is a national stage of PCT International Application No. PCT/EP2009/001002, filed Feb. 13, 2009, which claims priority under 35 U.S.C. §119 to German Patent Application No. 10 2008 012 388.9, filed Mar. 4, 2008, the entire disclosures of which are herein expressly incorporated by reference.

BACKGROUND AND SUMMARY OF THE INVENTION

The invention relates to a sanitary functional unit comprising a sleeve-shaped insert cartridge that can be inserted into the tubular fitting outlet of a sanitary outlet fitting in order to form the emerging water jet. In this case the insert cartridge has a water inflow on at least one of its face sides and a water outlet on the cartridge circumference. In addition, the water outlet has a jet former that has flow guide walls that are oriented transversely and preferably at right angles to the longitudinal axis of the cartridge.

Jet regulators that can be inserted into the water outlet of a sanitary outlet fitting already exist in a variety of embodiments. Such jet regulators are used to form the water emerging from the outlet fitting into a homogenous and/or non-splashing water jet that is an aerated or non-aerated water jet. To this end, the region of the face sided water inflow of the prior art jet regulators exhibits a jet splitter that splits the water flowing into the sleeve-shaped insert cartridge into a plurality of individual jets that are formed again into a homogeneous total jet no later than in the region of the outflow-sided water outlet.

FR 1 600 307 discloses a sanitary functional unit that is configured as a hand-held shower head and has a synthetic resin body that consists of a sub-area configured as a handle and a sub-area serving as the outlet chamber. The interior of the handle contains a metal pipe. A metal intermediate piece that is configured as an insert cartridge is inserted into the sub-area of the metal pipe that faces away from the outlet chamber. The metal intermediate piece has a face sided water inflow, which is connected to the pipe in the handle, and a water outlet that is bent at right angles to said water inflow. However, the functional unit of publication FR 1 600 307 is not configured as a jet regulator that could form a homogeneous and/or non-splashing water jet.

The current trend is to configure sanitary outlet fittings so as to be not only functional, but also aesthetically unique. As a result, there are outlet fittings that have an essentially tubular water outlet, where the outlet mouthpiece is provided on the pipe circumference. Such an outlet mouthpiece requires much effort to accommodate a sleeve-shaped insert cartridge from the side direction.

Therefore, the object of the invention is to provide a jet regulator of the kind that is described in the introductory part and that can also be used advantageously in such areas of application, in order to form a homogeneous and/or non-splashing water jet.

The inventive solution to this problem involves, in particular, of the fact that the insert cartridge has a water inflow on at least one of its face sides and/or that at least one aeration channel is integrated into the insert cartridge.

The functional unit according to the invention has an insert cartridge that can be inserted into the tubular fitting outlet of an outlet fitting and can have a water inflow on its two face sides. In this case the cartridge circumference has a water outlet with a jet former that has flow guide walls that are oriented transversely and preferably at right angles to the longitudinal axis of the cartridge. Therefore, the functional unit according to the invention can deflect the water jet flowing in from the axial direction in such a manner that said water jet can subsequently flow out of the fitting outlet in an almost radial direction. To this end the functional unit according to the invention has primarily a jet former, which is provided in the region of the water outlet and which has flow guide walls that are oriented transversely to the longitudinal axis of the cartridge. At the same time these flow guide walls that are a part of the jet former and that are oriented transversely to the longitudinal axis of the cartridge form an arbitrary outlet structure and surround, for example, a honeycomb-like perforated structure in the water outlet. Since the functional unit according to the invention is oriented, for example, coaxially to the fitting outlet, this functional unit does not project beyond the pipe circumference in an unsightly manner even in the case of a certain installation length. The water inflows that are provided on the two face sides of the insert cartridge allow the use of either the one or the other water inflow as a function of which water inflow is positioned in the inflow direction of the water stream. In addition to or instead of the water inflows provided on the two face sides of the insert cartridge, the above proposed problem can also be solved in that the at least one aeration channel is integrated into the insert cartridge. If the functional unit of the invention includes an aeration channel and this aeration channel is integrated into the insert cartridge, then the jet regulator of the invention can serve as an aerated jet regulator.

In order to be able to retain the dirt particles that may be entrained in the inflowing water before the water flows into the insert cartridge, it is advantageous to provide a pre-screen or dirt screen on the inflow side upstream of at least one water inflow of the insert cartridge.

In this respect the pre-screen can also be replaced or removed, as desired, if the pre-screen(s) can be mounted in a detachable manner on the cartridge housing.

In order to be able to introduce the insert cartridge into the fitting outlet from the direction of the free face side of the fitting outlet and then to be able to also rotate said insert cartridge into the desired position, it is expedient to configure the sleeve-shaped insert cartridge so as to be closed on its face end facing away from the water inflow and/or it is expedient for the sleeve-shaped insert cartridge to exhibit a tool engagement area for a screwdriver or rotating tool.

An especially advantageous further development of the invention provides that each of the two face sides of the insert cartridge has a water inflow. The improved embodiment allows, as required, the use of either the one or the other water inflow as a function of which water inflow is positioned in the inflow direction of the water stream.

Working on this basis, it is especially advantageous to configure the insert cartridge as a replacement cartridge that has a water inflow on each of its face sides, and to provide the water inflows, which are provided on the opposite sides of the insert cartridge, for a plurality of water pressure conditions, flow rates and the like water properties of the inflowing and/or outflowing water. In this way such insert cartridges can be used to change and vary the water properties. In order to vary the water properties, it is possible, for example, to combine the water inflows, provided on the opposite face sides of the insert cartridge, with different pre-screens, flow rate regulators, flow limiters, jet splitters, homogenization units and/or jet formers. In this respect the different components that are used on the opposite face sides can exhibit a color code that facilitates the assignment and differentiation of even such components that exhibit the same function to, for example, individual flow or performance classes.

Depending on the application, the functional unit of the invention can be configured as an aerated or non-aerated jet regulator. Insofar as the functional unit of the invention is configured as an aerated jet regulator, then it may be advantageous to provide at least one aeration channel that empties into the outflow-sided region of at least one jet splitter. In this respect a preferred embodiment of the invention provides that at least the one aeration channel is integrated into the insert cartridge and/or that the channel inlet of at least one aeration channel is provided in the cartridge end that faces away from the water inflow.

In order to be able to construct the functional unit of the invention as a modular design, it is expedient to be able to insert in a detachable manner the jet former into the water outlet of the insert cartridge.

Working on this basis, a preferred embodiment of the invention provides that the region of the water outlet exhibits an interior thread, in which the jet former, which is configured preferably as an insert component, can be fastened in a detachable manner by means of an exterior thread.

Similarly an especially preferred embodiment of the functional unit of the invention can provide that at least one additional jet-forming unit can be connected to the jet former. This additional jet-forming unit conforms with the contour of the pipe recess of the fitting outlet in the region in which the jet emerges so that the result is a cylindrical circumference of the outlet pipe that satisfies the high aesthetic requirements, because the outlet pipe exhibits a continuous cylindrical contour that is interrupted by the flow channels of the superstructure only in the region in which the water emerges.

The jet splitter of the functional unit of the invention can be configured, for example, as a diffuser. In order, however, to limit the number of noise-inducing flow deflections, it can be expedient to configure the jet regulator as a perforated plate. In this case a preferred embodiment of the invention provides that the jet splitter is held in a detachable manner in the insert cartridge.

Other embodiments of the invention are apparent from the claims and the drawings. The invention is explained in detail below with reference to the preferred embodiments.

DETAILED DESCRIPTION OF THE DRAWINGS

Figures 1, 2:
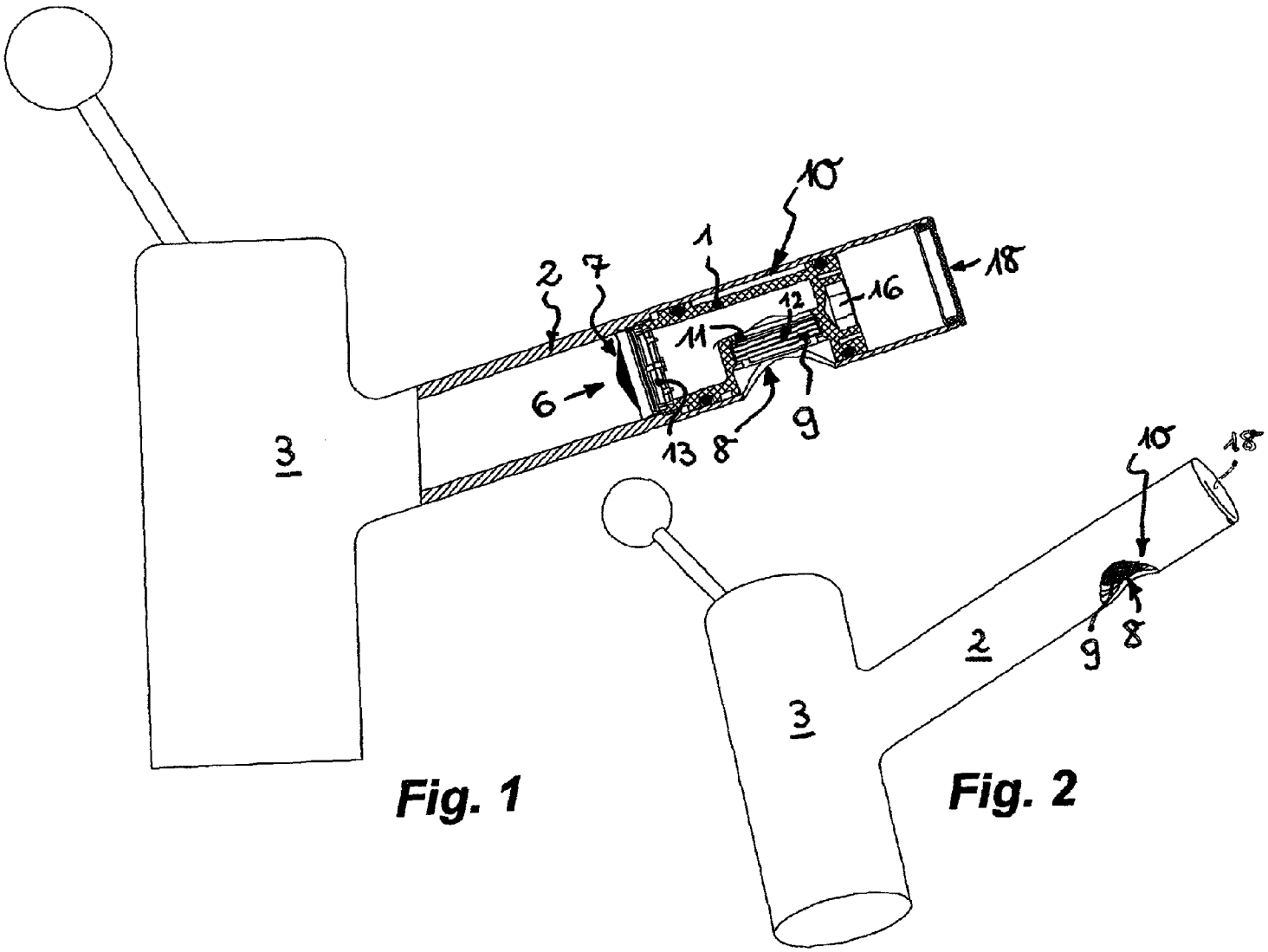
FIG. 1 shows a sanitary outlet fitting, which is shown cut open in the region of its tubular fitting outlet, into which a sanitary functional unit is inserted in order to form a homogeneous and non-splashing water jet.
FIG. 2 shows the outlet fitting from FIG. 1 in a perspective view from the top down onto the fitting underside, as a result of which the water outlet can be easily recognized.
Figure 3:
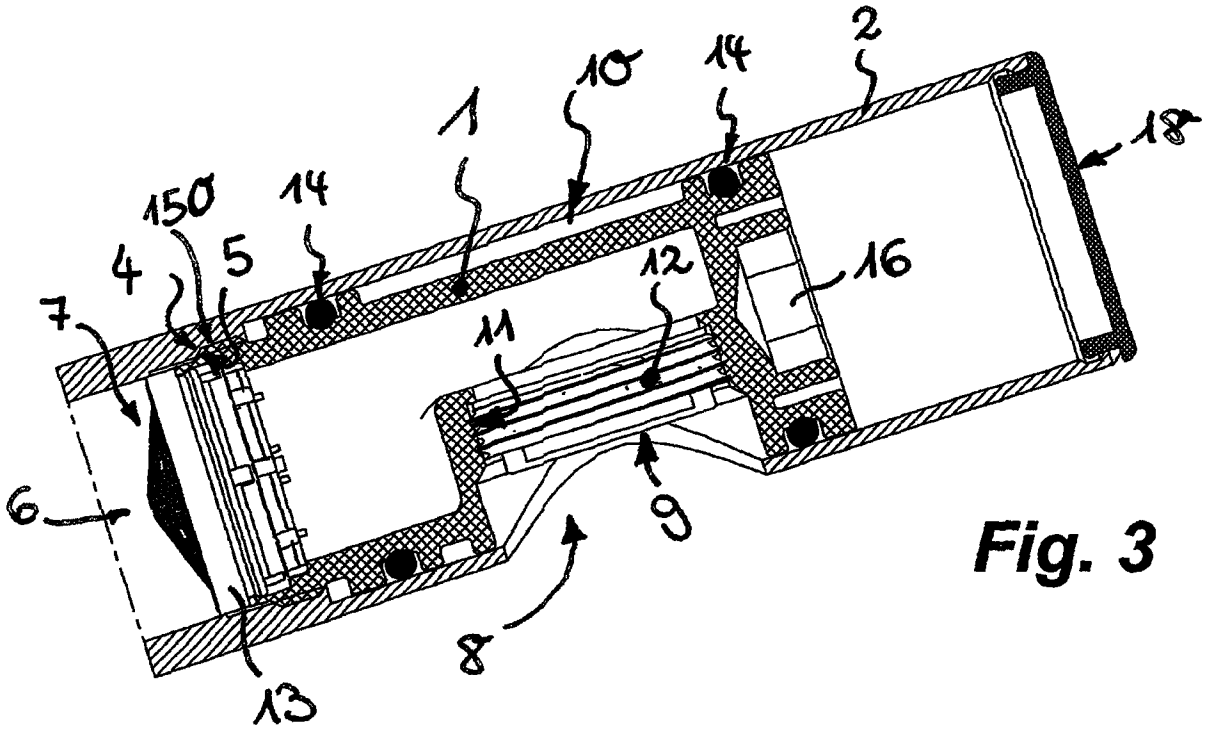
FIG. 3 is a sectional view of the outlet fitting from FIGS. 1 and 2 in the region of the fitting outlet that exhibits the sanitary functional unit.

FIGS. 1 to 14 show a variety of embodiments 10, 20, 30 of a sanitary functional unit that is a sleeve-shaped insert cartridge 1 insertable in a detachable manner into the tubular fitting outlet 2 of a sanitary outlet fitting 3. FIGS. 3, 5 and 9 show that the functional unit 10, 20, 30 can be inserted into the fitting outlet as far as up to an insert stop 4 from the direction of the free face end. In this case the face edge region of the insert cartridge 1 (which can be regarded as the front when viewed in the insert direction) serves as the insert stop 4 that interacts with a counter-stop that is provided on the inner circumference of the fitting outlet 2 and is designed herein as an annular flange 5. In this case the two stops 4, 5 can be configured especially advantageously as threaded stops without having to show them here in detail.

The insert cartridges 1 of the functional units 10, 20, 30 have on at least one of their face sides a water inflow 6, upstream of which the inflow side includes a filter or prescreen 7 that projects in the shape of a cone in the opposite direction of flow. The insert cartridges 1 have a water outlet 8 on their cartridge circumference. The water outlet 8 has a jet former 9 with flow guide walls that run preferably coaxially to each other and are oriented transversely to the longitudinal axis of the cartridge. This jet former 9 can have, for example, flow guide walls that are oriented at right angles to the longitudinal axis of the cartridge or are configured as a perforated structure, of which the flow guide walls defining the flow holes form a honeycomb-like structure.

The functional units 10, 20, 30 can deflect the water jet, which can flow in from the axial direction, in such a manner that this water jet can then flow out of the fitting outlet in an almost radial direction. To this end, the functional units 10, 20, 30 includes, above all, the jet former 9, which is provided in the region of the water outlet 8 and which has flow guide walls that are oriented in the radial direction. Since the functional units 10, 20, 30 are oriented approximately coaxially to the fitting outlet, these functional units project beyond the pipe circumference of the fitting outlet 2 so as not to be unsightly even in the case of a certain installation length.

Figure 4:
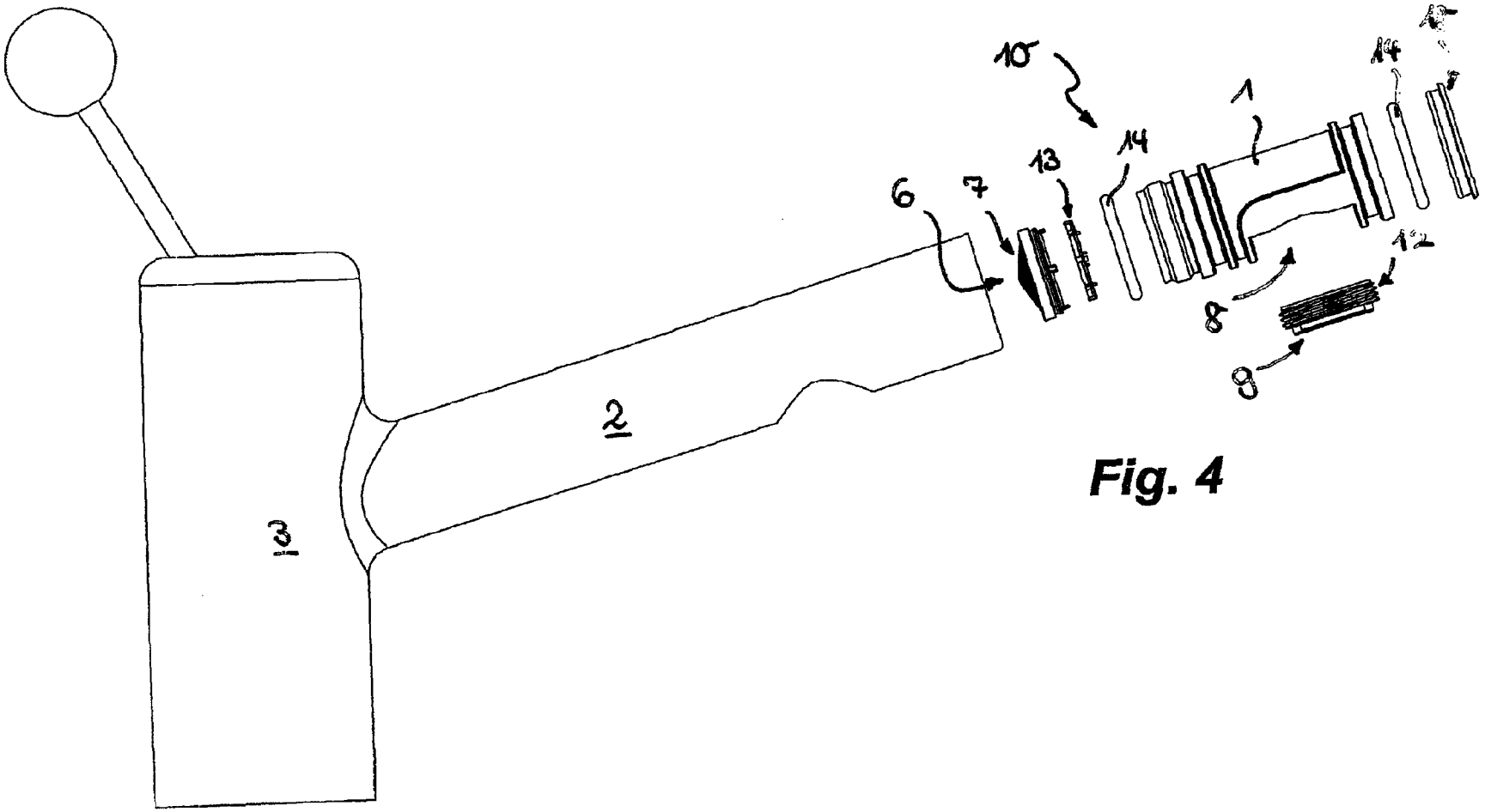
FIG. 4 is an exploded view of the components of the outlet fitting from FIGS. 1 to 3, from which it is clear that the sanitary functional unit can be inserted into the tubular fitting outlet from the direction of the free face end.
Figures 5, 6:
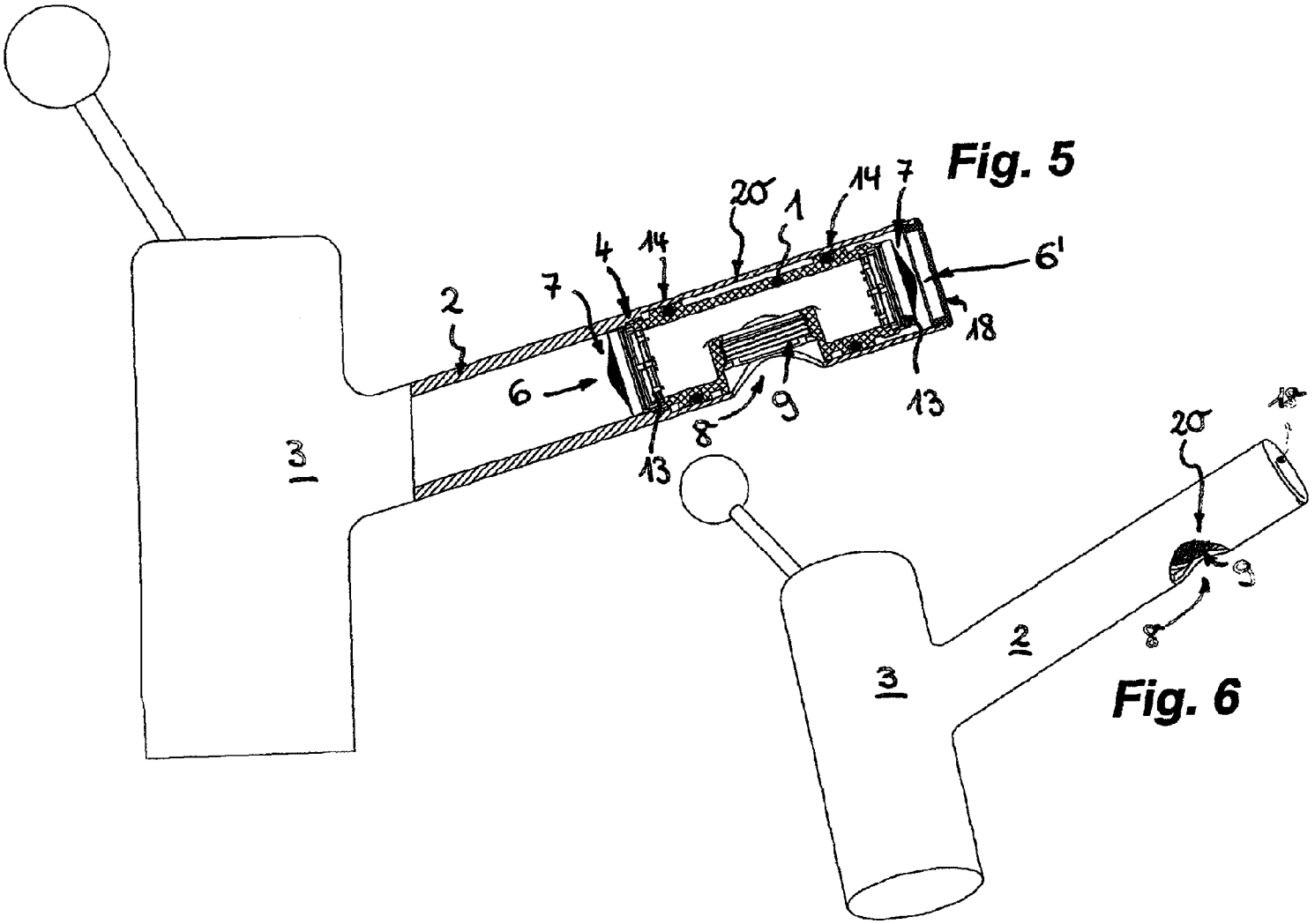
FIG. 5 shows an outlet fitting comprising a sanitary functional unit that is configured as a replacement cartridge that has on each of its face sides a water inflow, where the water inflows that are provided on the opposite sides of the replacement cartridge are provided for a variety of water properties of the inflowing and/or outflowing water.
FIG. 6 shows the outlet fitting from FIG. 5 in a perspective view from the top down onto the fitting underside.
Figure 7:
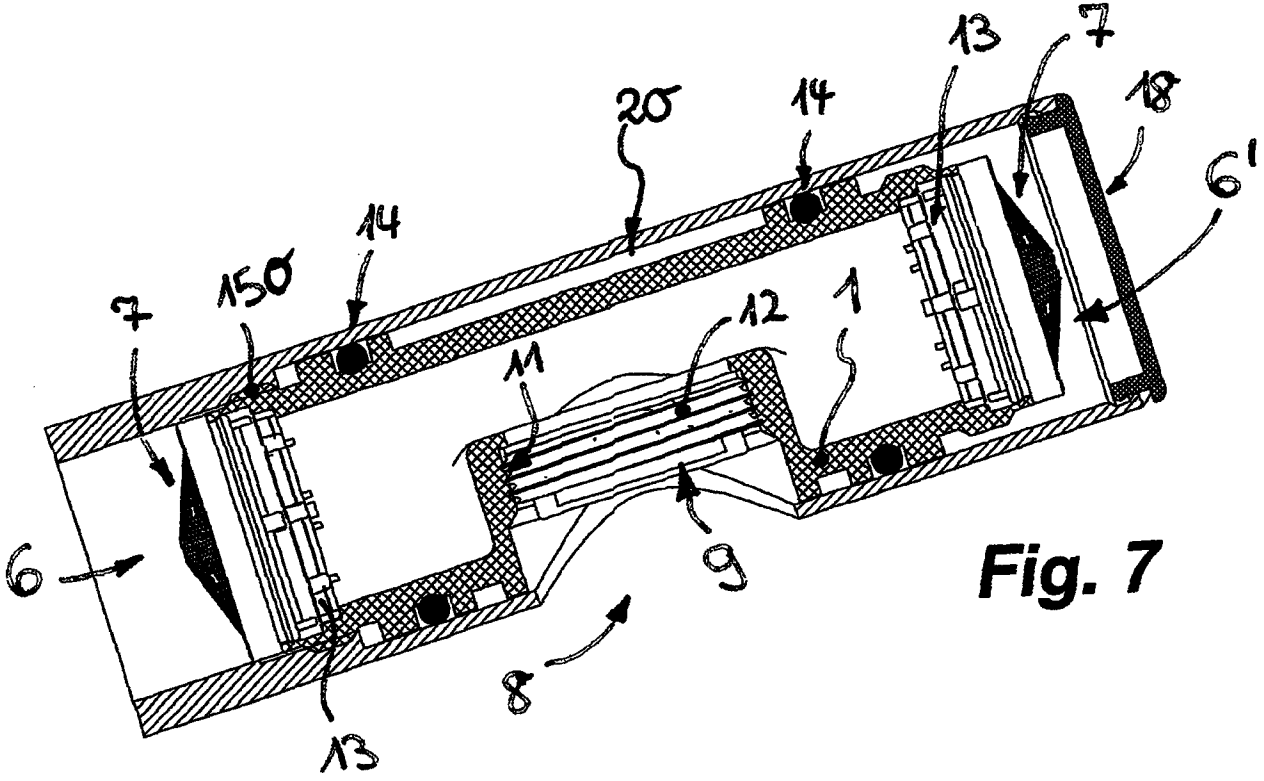
FIG. 7 is a sectional view of the outlet fitting from FIGS. 5 and 6 in the region of the fitting outlet exhibiting the sanitary functional unit.
Figure 8:
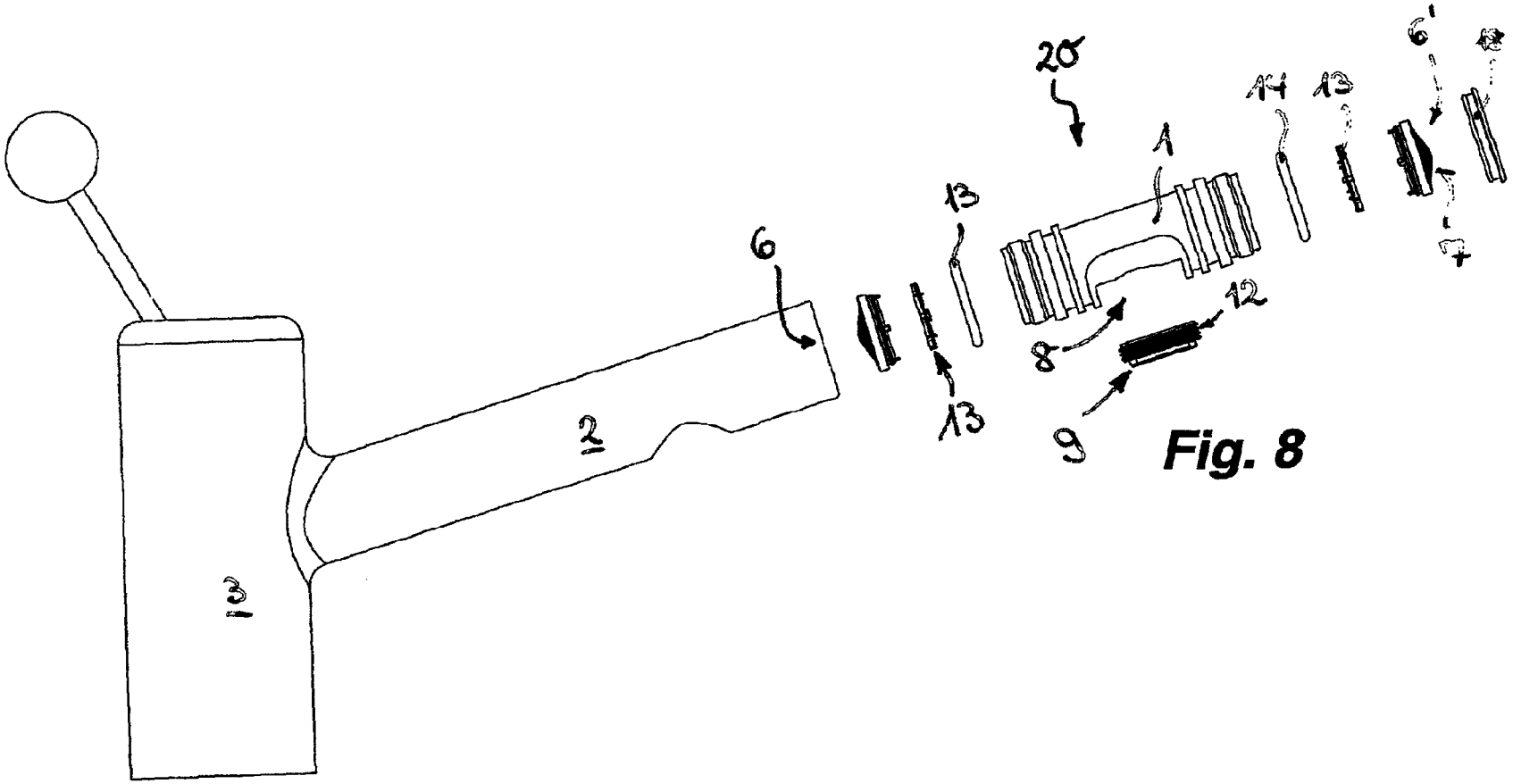
FIG. 8 is an exploded view of the components of the outlet fitting from FIGS. 5 to 7.
Figures 9, 10:
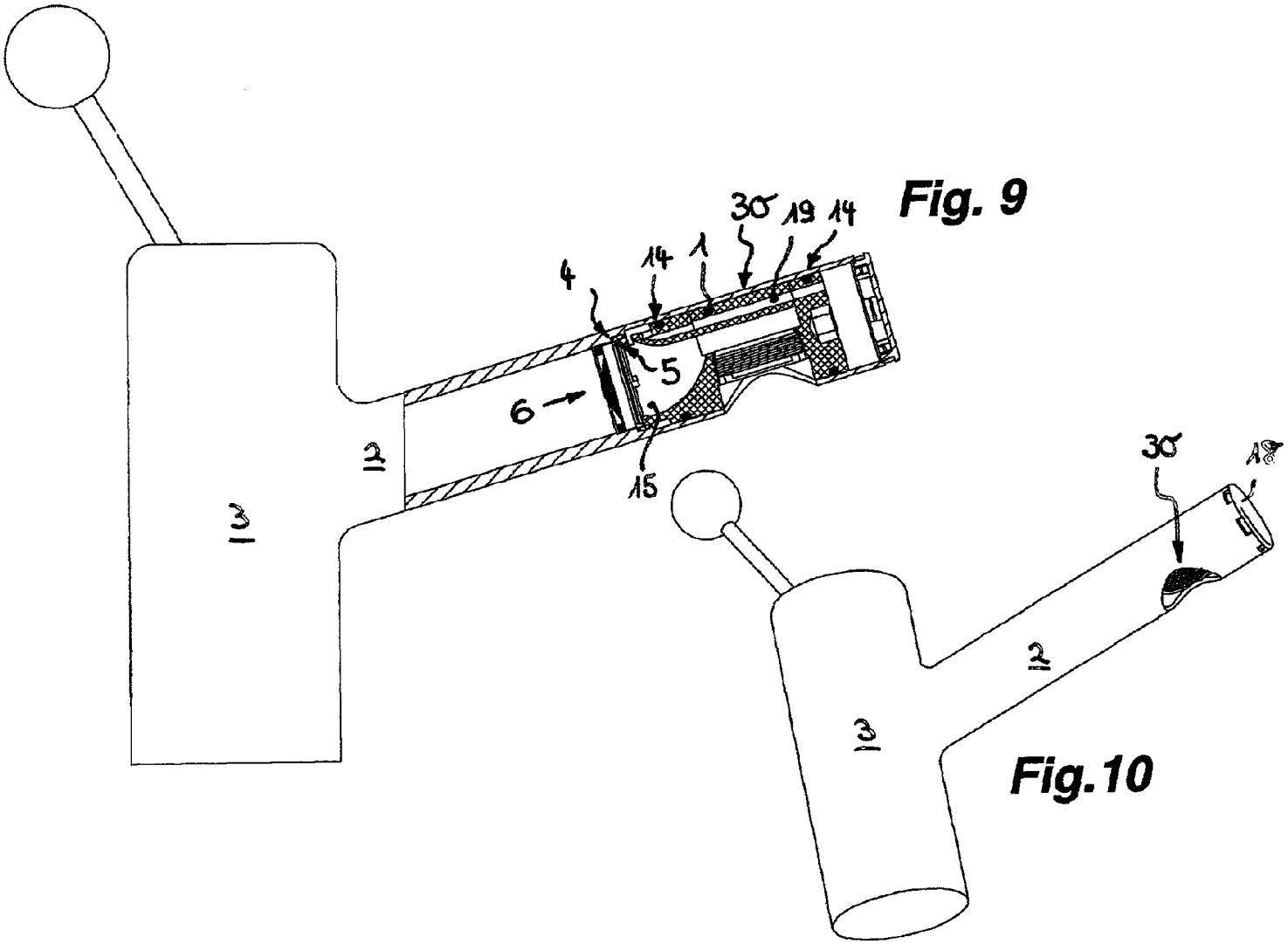
FIG. 9 shows an outlet fitting with a sanitary functional unit that is configured here as an aerated jet regulator for forming a homogeneous and pearly soft water jet.
FIG. 10 shows the outlet fitting from FIG. 9 in a perspective view from the top down onto the fitting underside.
Figure 12:
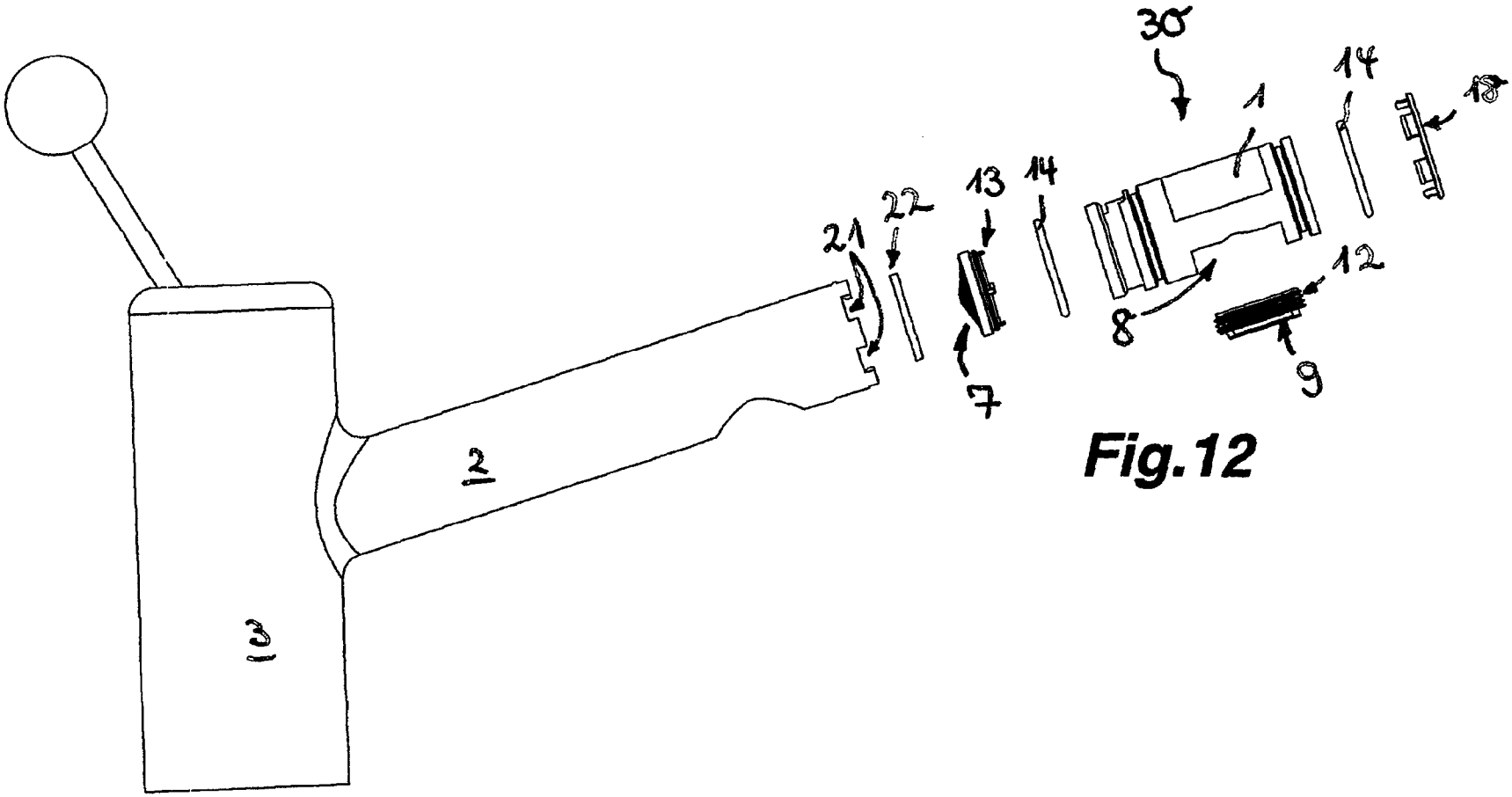
FIG. 12 is an exploded view of the components of the outlet fitting from FIGS. 9 to 11.

FIGS. 4, 8 and 12 show that the pre-screens 7 with the downstream jet splitters 13, on the one hand, and the jet formers 9, on the other hand, are held in a detachable manner in the insert cartridge 1. Whereas the pre-screens 7 and/or the jet splitters 13 downstream of said pre-screens can be snapped in a detachable manner into the face side of the cartridge, the region of the water outlet 8 has an interior thread 11, in which the jet former 9, which is configured as an insert component, can be fastened in a detachable manner by means of an exterior thread 12.

It is also clear from FIGS. 4, 8 and 12 that the insert cartridges 1 have at least one water inflow 6 with a jet splitter 13, which divides the inflowing water stream into a plurality of individual jets. In this respect this jet splitter 13 is configured here as a perforated plate that is oriented transversely to the direction of flow and that has a plurality of throughflow holes.

In this case the functional units 10, 20, 30 include a jet regulator that is intended for forming the emerging water jet. Whereas the jet regulators 10, 20 in FIGS. 1 to 4 or 5 to 8 respectively are designed as laminar jet regulators, that is, as non-aerated jet regulators, the jet regulator 30, depicted in FIGS. 9 to 12, is designed as an aerated jet regulator that forms an aerated and, thus, pearly soft water jet.

To this end, the sleeve circumference of the sleeve-shaped insert cartridge 1 of the jet regulator 30 contains at least one aeration channel 19 that empties into the downstream region of the jet splitter 13 that is provided as the mixing zone 15. Since the throughflow holes in the jet splitter 13 taper off in the flow cross section, the flow rate of the water stream automatically increases in said throughflow holes so that the result is a negative pressure on the outflow side of the jet splitter 13. The effect of this negative pressure is an intake of the air required to aerate the water jet. To this end, the channel inlet 17 of at least one aeration channel 14, which is integrated into the insert cartridge 1, is provided in the end of the cartridge that faces away from the water inflow 6.

The jet regulators 10, 30 that are depicted in FIGS. 1 to 4 and 9 to 12 are configured so as to be closed on their face end facing away from the water inflow 6. In this case the closed face side of the jet regulators 10, 30 has a tool engagement area 16 that is configured here as a hexagonal recess that allows, for example, the insert cartridge 1 that is situated in the fitting outlet 2 to be rotated until the water outlet 8 of the insert cartridge 1 and the fitting outlet 2 are in alignment with each other.

In contrast, the jet regulator 20, depicted in FIGS. 5 to 8, has an insert cartridge 1 that is configured as a replacement cartridge. Each face side of the replacement cartridge of the jet regulator 20 has a water inflow 6, 6'. In this case the water inflows 6, 6' that are provided on opposite sides are provided for a plurality of water pressure conditions, flow rates or the like water properties of the inflowing and/or outflowing water. The insert cartridge 1 of the jet regulator 20 makes it possible to use, as required, either the one or the other water inflow 6, 6' as a function of which water inflow 6, 6' is positioned in the inflow direction of the water stream. In this way the same insert cartridge 1 can be used to change or to vary the water properties. In order to vary the water properties, it is possible, for example, to combine the water inflows 6, 6', provided on the opposite face sides of the insert cartridge 1, with different pre-screens 7, flow rate regulators, flow limiters, jet splitters 13, homogenization units and/or jet formers 9.

In this respect the different components that are used on the opposite face sides can exhibit a color code that facilitates the assignment and differentiation of even such components that exhibit the same function to, for example, individual flow or performance classes.

Figure 11:
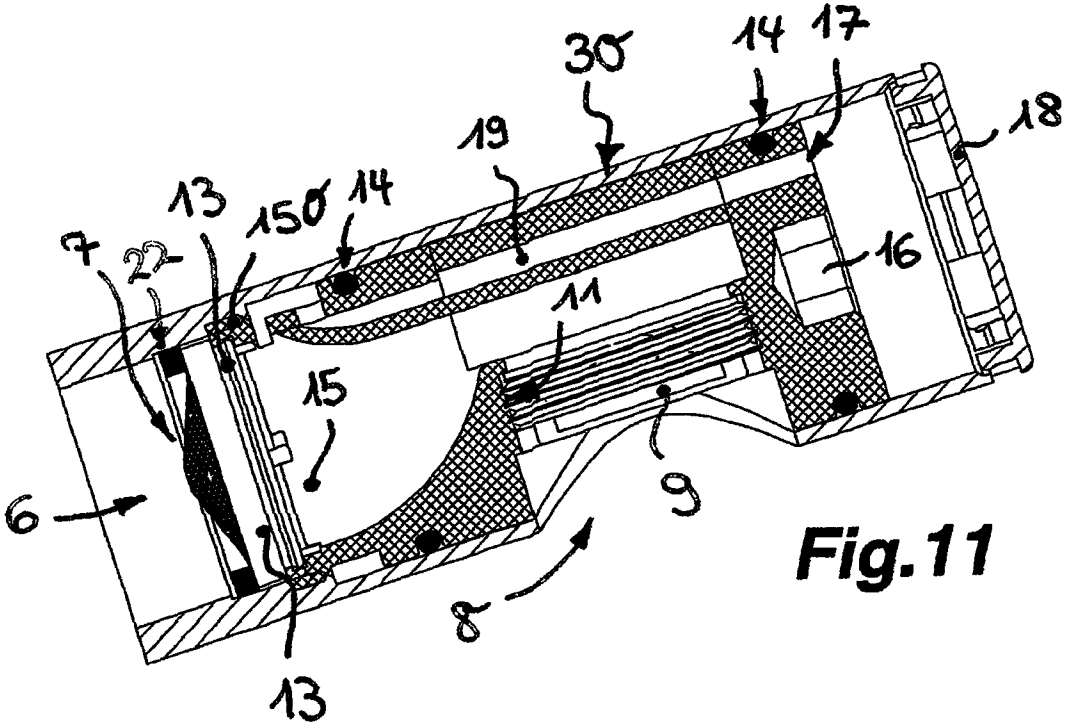
FIG. 11 is a sectional view of the outlet fitting from FIGS. 9 and 10 in the region of the fitting outlet exhibiting the sanitary functional unit.

It is clear from FIGS. 1 to 12 that the annular space between the outer circumference of the insert cartridge 1 and the inner circumference of the fitting outlet 2 is sealed by at least one ring seal, preferably a sealing ring 14. FIGS. 1 to 12 show that the circumferential edge region of the two face sides of the insert cartridges 1 bears a sealing ring 14. FIGS. 1 to 12 show that the jet splitter 13 that is configured as a perforated plate and is a part of the functional units 10, 20, 30 is snapped in a detachable manner on the inflow sided face end of the insert cartridge 1 by means of a snap lock connection. The inflow sided circumferential region of the insert cartridges 1 of the functional units 10, 20, 30 exhibits preferably an exterior thread 150 that can be screwed together with an interior thread on the inside circumference of the fitting outlet 2. This screw connection between the insert cartridge 1 and the fitting outlet 2 ensures the correct operating position of the insert cartridge 1 in the fitting outlet 2. However, it is also possible to connect the insert cartridge 1 to a lid 18, which is provided on the free face end of the fitting outlet 2. Then this lid can subsequently secure and hold the insert cartridge 1 in the fitting outlet. FIG. 11 shows that the aeration channel 14 is disposed in the upper region of the insert cartridge 1, in order to counteract an outflow of water from the aeration channel 14. In order to draw in air by way of the channel port, the lid 18 does not close air tight at the fitting outlet. The crown-shaped free face end of the fitting outlet has air intake openings 21, which are held open by the lid.

In the region of the insert stop the insert cartridge 1 of the jet regulator 30 is sealed on the circumferential side with a ring seal 22 that is loaded in the axial direction.

Figure 14:
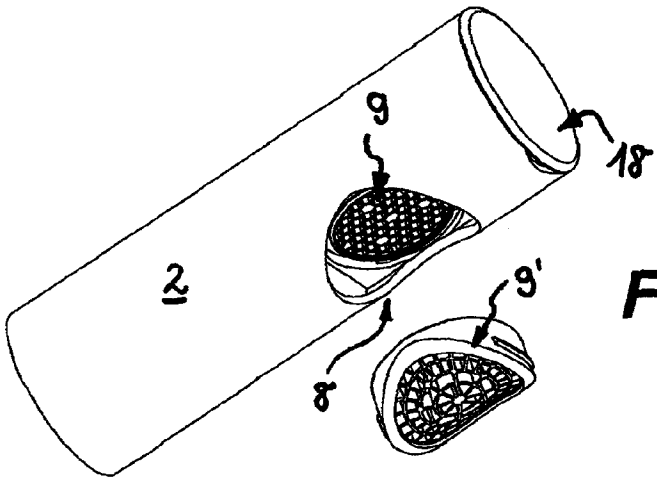
FIG. 14 is an exploded view of the outlet fitting from FIG. 13, where the jet-forming unit, which is separated from the fitting outlet, is shown at a distance from the fitting outlet.
Figure 13:
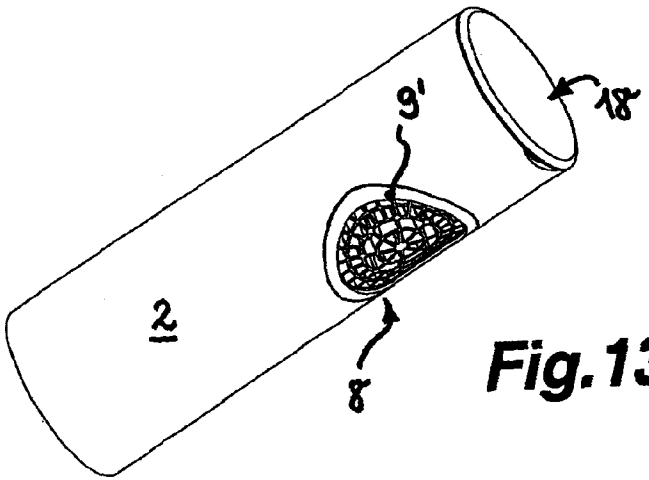
FIG. 13 is a perspective view of an outlet fitting comparable to the outlet fitting shown in FIGS. 1 to 4, where the outlet fitting has here a jet-forming unit that is provided on the fitting outlet and which conforms with the contour of the pipe recess of the fitting outlet in the region in which the jet emerges.

It is apparent from FIGS. 13 and 14 that the sanitary functional unit 30 can also be assigned a jet-forming unit 9' that can be mounted on the fitting outlet in such a manner that its outer contour conforms with the pipe recess of the fitting outlet 2 in the region in which the jet emerges. At the same time the jet-forming unit 9' can also be downstream of the jet former 9 of the insert cartridge 1 or can form its sole jet former 9. The embodiment depicted in FIGS. 13 and 14 shows that following assembly of the insert cartridge 1 and the jet former 9, the jet-forming unit 9' is snapped in or fastened in a similar manner in the fitting outlet 2 from the direction of the outlet side, so that the outlet structure of this jet-forming unit 9' rests flush with the contour of the pipe recess forming the water outlet.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A sanitary functional unit comprising:

a sleeve-shaped insert cartridge insertable into a tubular fitting outlet of a sanitary outlet fitting in order to form an emerging water jet, wherein the insert cartridge includes at least one water inflow on one of its face sides;

a water outlet on a circumference of the insert cartridge, wherein the water outlet has a jet former with flow guide walls oriented transversely or at right angles to a longitudinal axis of the insert cartridge; and another water inflow on another of its face sides, wherein the at least one and the another water inflows are provided on opposite sides of the insert cartridge, the insert cartridge is insertable entirely into a tubular fitting outlet with two alternative orientations, and the insert cartridge provides different water pressure conditions or flow rates of inflowing or outflowing water depending upon whether the insert cartridge is inserted into the tubular fitting outlet in a first or second one of the two alternative orientations, wherein in both alternative orientations water flows into one of the at least one water inflow and the another water inflow in a first direction and exits the insert cartridge via the water outlet in a second direction that is different from the first direction.

2. The functional unit of claim 1, wherein a pre-screen or filter screen is provided on an inflow side upstream of the at least one water inflow or the another water inflow of the insert cartridge.

3. The functional unit of claim 2, wherein the pre-screen is detachably mounted on the insert cartridge.

4. The functional unit of claim 3, further comprising:

a jet splitter, wherein the jet splitter is configured as a perforated plate or is detachably held in the insert cartridge.

5. The functional unit of claim 2, wherein pre-screen is detachably mounted on a jet splitter.

6. The functional unit of claim 5, wherein the jet splitter is configured as a perforated plate or is detachably held in the insert cartridge.

7. The functional unit of claim 1, wherein the at least one water inflow includes a jet splitter that divides an inflowing water steam into a plurality of individual jets.

8. The functional unit of claim 1, wherein the sanitary functional unit is configured as an aerated or non-aerated jet regulator.

9. The functional unit of claim 1, wherein the jet former is detachably inserted into the water outlet of the insert cartridge.

10. The functional unit of claim 1, wherein a region of the water outlet includes an interior thread in which the jet former, which is configured as an insert component, is detachably fastened by an exterior thread.

11. The functional unit of claim 1, wherein the insert cartridge has the another water inflow on the another of its face sides, wherein the longitudinal axis intersects the at least one water inflow and the another water inflow, and wherein the sleeve-shaped insert cartridge is configured so that inflowing water flows from the tubular fitting outlet into the at least one water inflow or the another water inflow in a direction along the longitudinal axis and exits the insert cartridge via the water outlet regardless of whether the at least one water inflow or the another water inflow is facing the inflowing water.

12. The functional unit of claim 1, wherein the jet former is arranged entirely within the insert cartridge.

13. The functional unit of claim 1, wherein the at least one and the another water inflows each include a different type of pre-screen.

14. The functional unit of claim 1, wherein the first direction is transverse to the second direction.

15. The functional unit of claim 1, wherein the first direction is perpendicular to the second direction.

16. A sanitary outlet fitting, comprising:

a tubular fitting outlet; and a sleeve-shaped insert cartridge inserted into the tubular fitting outlet of the sanitary outlet fitting in order to form an emerging water jet, wherein the insert cartridge includes at least one water inflow on one of its face sides; and a water outlet on a circumference of the insert cartridge, wherein the water outlet has a jet former with flow guide walls oriented transversely or at right angles to a longitudinal axis of the insert cartridge, wherein the insert cartridge has another water inflow on another of its face sides, wherein the tubular fitting outlet has a jet-forming unit, which conforms with a contour of a pipe recess of the tubular fitting outlet in a region in which the water jet emerges, and wherein the insert cartridge is insertable entirely into the tubular fitting outlet with two alternative orientations, wherein in both alternative orientations water flows into one of the at least one water inflow and the another water inflow in a first direction and exits the insert cartridge via the water outlet in a second direction that is different from the first direction.

17. The sanitary outlet fitting of claim 16, wherein the jet former is arranged entirely within the insert cartridge.

18. The sanitary outlet fitting of claim 16, wherein the at least one and the another water inflows each include a different type of pre-screen.

19. The sanitary outlet fitting of claim 16, wherein the first direction is transverse to the second direction.

20. The sanitary outlet fitting of claim 16, wherein the first direction is perpendicular to the second direction.

* * * * *